US008511795B2

(12) United States Patent
Hu et al.

(10) Patent No.: US 8,511,795 B2
(45) Date of Patent: Aug. 20, 2013

(54) THREE-DIMENSIONAL PRINTER

(75) Inventors: Hsing-Yi Hu, Taipei Hsien (TW); Chen-Hsing Cheng, Taipei Hsien (TW); Wuu-Jyi Lin, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 419 days.

(21) Appl. No.: 12/688,059

(22) Filed: Jan. 15, 2010

(65) Prior Publication Data

US 2011/0012961 A1 Jan. 20, 2011

(30) Foreign Application Priority Data

Jul. 14, 2009 (CN) ..... 2009 1 0157566

(51) Int. Cl.
*B41J 2/14* (2006.01)
*B41J 2/16* (2006.01)

(52) U.S. Cl.
USPC ..... 347/47

(58) Field of Classification Search
USPC ..... D18/50; 427/427.1; 901/43
See application file for complete search history.

(56) References Cited

U.S. PATENT DOCUMENTS

2005/0046666 A1 3/2005 Horio et al.
2009/0284566 A1* 11/2009 Suzuki et al. ..... 347/38
2011/0262622 A1* 10/2011 Herre et al. ..... 427/8

FOREIGN PATENT DOCUMENTS

CN 1833928 9/2006

* cited by examiner

*Primary Examiner* — Matthew Luu
*Assistant Examiner* — Renee I Wilson
(74) *Attorney, Agent, or Firm* — Altis Law Group, Inc.

(57) ABSTRACT

A three-dimensional printer includes an inkjet head and a nozzle plate. The inkjet head includes a top wall and two sidewalls connecting with the top wall. The top wall of the inkjet head includes a top nozzle. Each sidewall includes a side nozzle. The nozzle plate is positioned on an inner surface of the inkjet head. The nozzle plate includes a top area and two opposite side areas connecting with the top area. The top area of the nozzle plate includes a plurality of holes corresponding to the top nozzle of the inkjet head. Each side area of the nozzle plate includes a plurality of holes corresponding to the side nozzle of the inkjet head.

8 Claims, 5 Drawing Sheets

THREE-DIMENSIONAL PRINTER

BACKGROUND

1. Technical Field

The disclosure generally relates to printers, and particularly to a three-dimensional printer.

2. Description of Related Art

Computer printers typically print on sheet media such as paper or transparencies. Some printers utilize a nozzle of an inkjet head to print on a planar surface of a workpiece. However, non-planar surfaces cannot be printed.

What is needed, therefore, is a three-dimensional printer addressing the limitations described.

DETAILED DESCRIPTION OF THE EMBODIMENT

Figure 1:
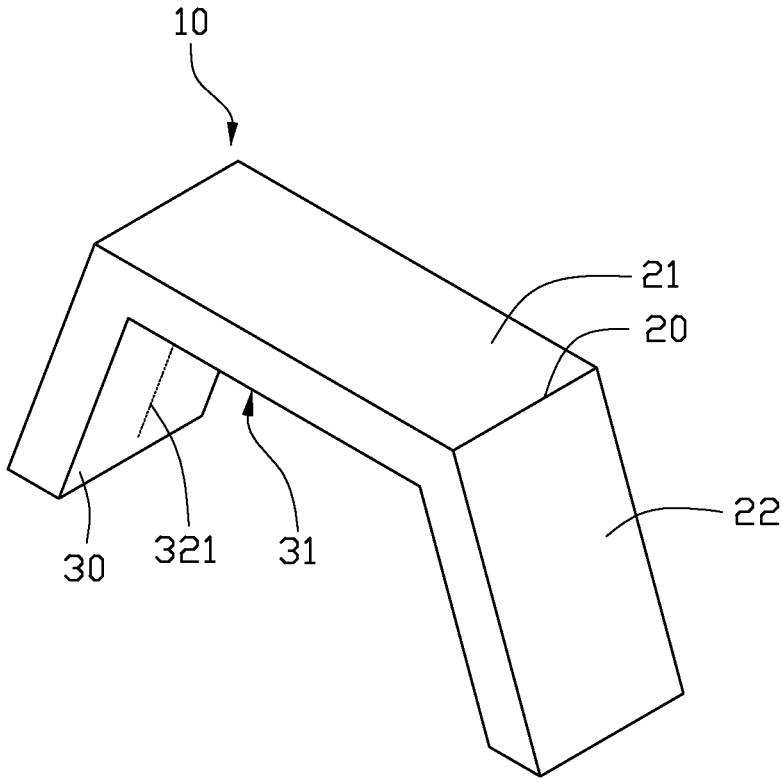
FIG. 1 is a perspective view of an embodiment of a three-dimensional printer.
Figure 2:
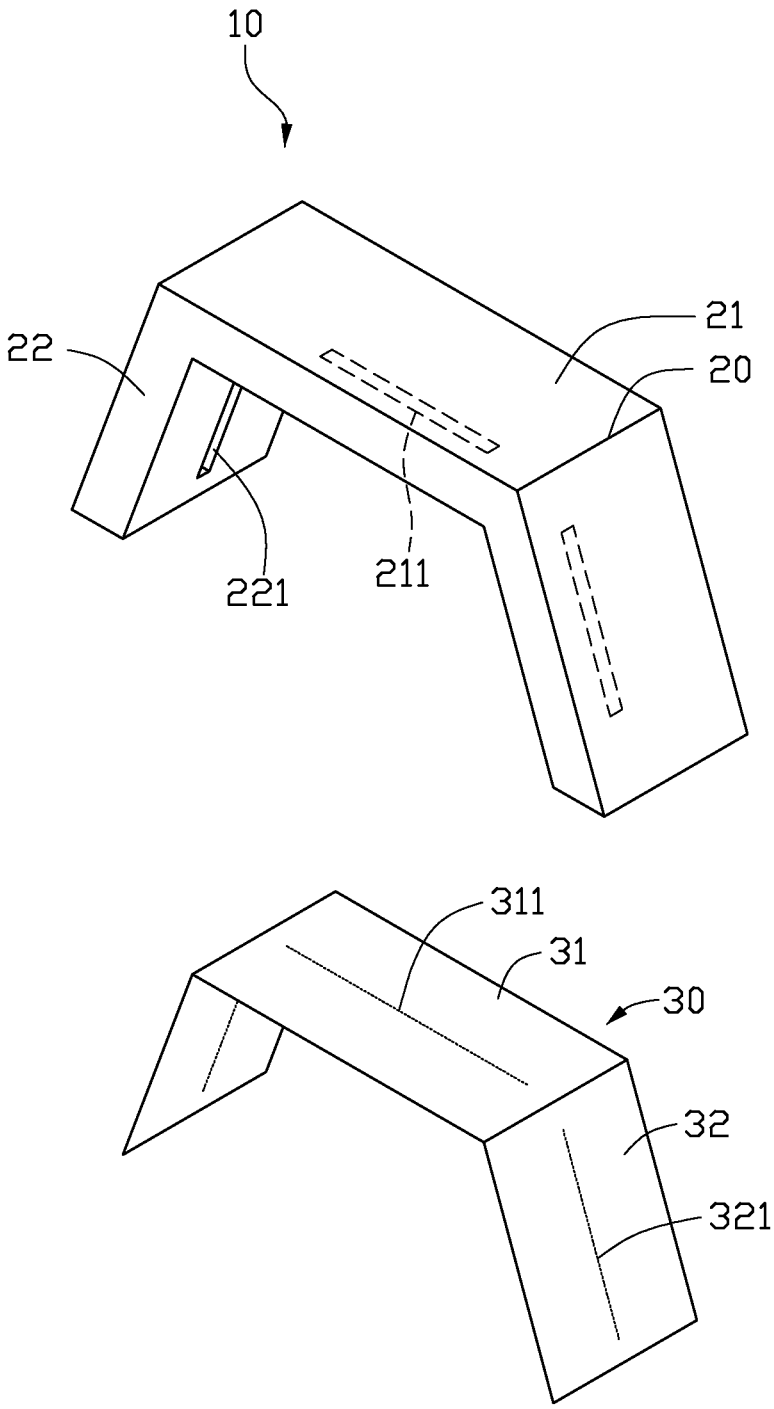
FIG. 2 is an exploded perspective view of the three-dimensional printer of FIG. 1.

Referring to FIGS. 1 and 2, an embodiment of a three-dimensional printer 10 includes an inkjet head 20 and a nozzle plate 30.

The inkjet head 20 includes a top wall 21 and two opposite sidewalls 22 connecting with the top wall 21. The two sidewalls 22 can be integrally formed with the top wall 21 or attached to the top wall 21. In the illustrated embodiment, the sidewalls 22 are integrally formed with the top wall 21, such that the inkjet head 20 forms an inverted U-shape. However, the inkjet head 20 can form any shape. An inner surface of the top wall 21 includes a top nozzle 211. An inner surface of each sidewall 22 includes a side nozzle 221.

The nozzle plate 30 is positioned on the inner surface of the inkjet head 20. The nozzle plate 30 includes a top area 31 and two opposite side areas 32 connecting with the top area 31. The two side areas 32 can be integrally formed with the top area 31 or attached to the top area 31. In the illustrated embodiment, the nozzle plate 30 has an inverted U-shape, but can be any other shape. The top area 31 of the nozzle plate 30 includes a plurality of holes 311 corresponding to the top nozzle 211 of the inkjet head 20. Each side area 32 of the nozzle plate 30 includes a plurality of holes 321 corresponding to the side nozzle 221 of the inkjet head 20. The numbers and the location of the holes 311, 321 can be adjusted according to printing requirements.

Figure 3:
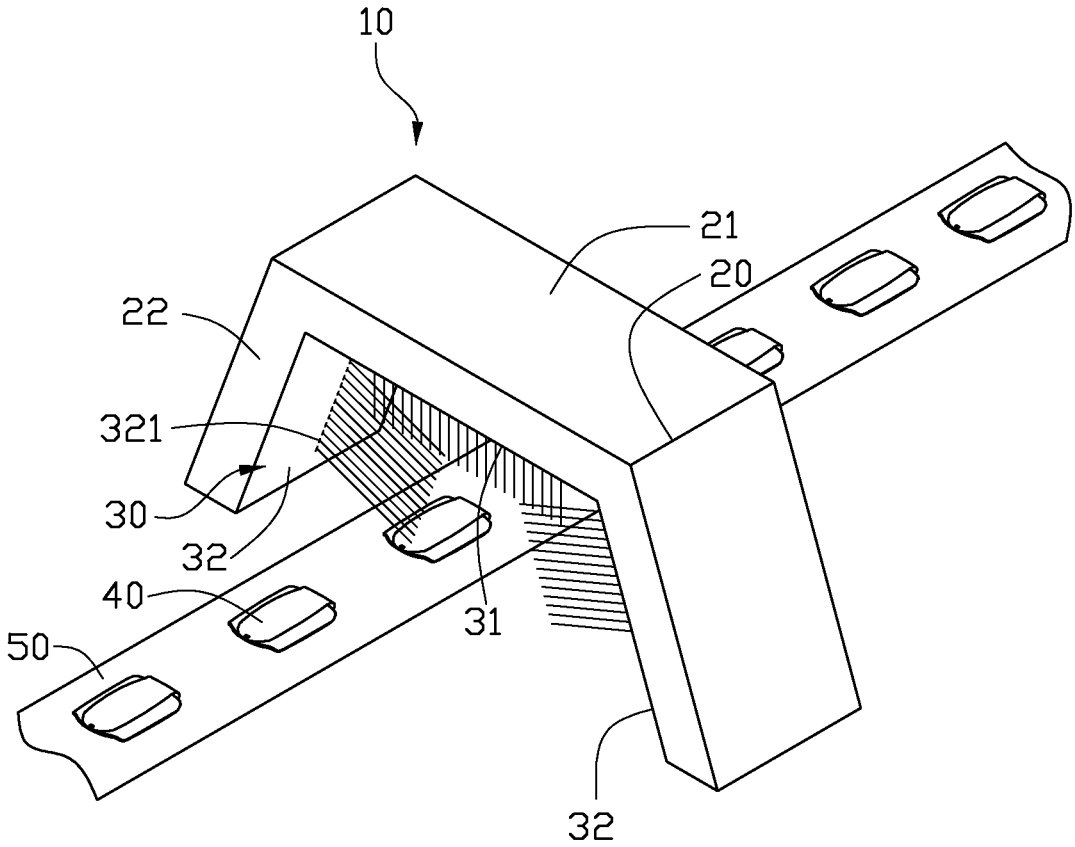
FIG. 3 is a schematic view of the three-dimensional printer of FIG. 1.

Referring to FIG. 3, the top area 31 and the two side areas 32 of the nozzle plate 30 define a plurality of holes 311, 321. When a workpiece 40 enters the printer 10 by the conveyer belt 50, the top nozzle 211 of the inkjet head 20 prints on a top surface of the workpiece 40, and the two side nozzles 211 of the inkjet head 20 print on two side surface of the workpiece 40.

Figure 4:
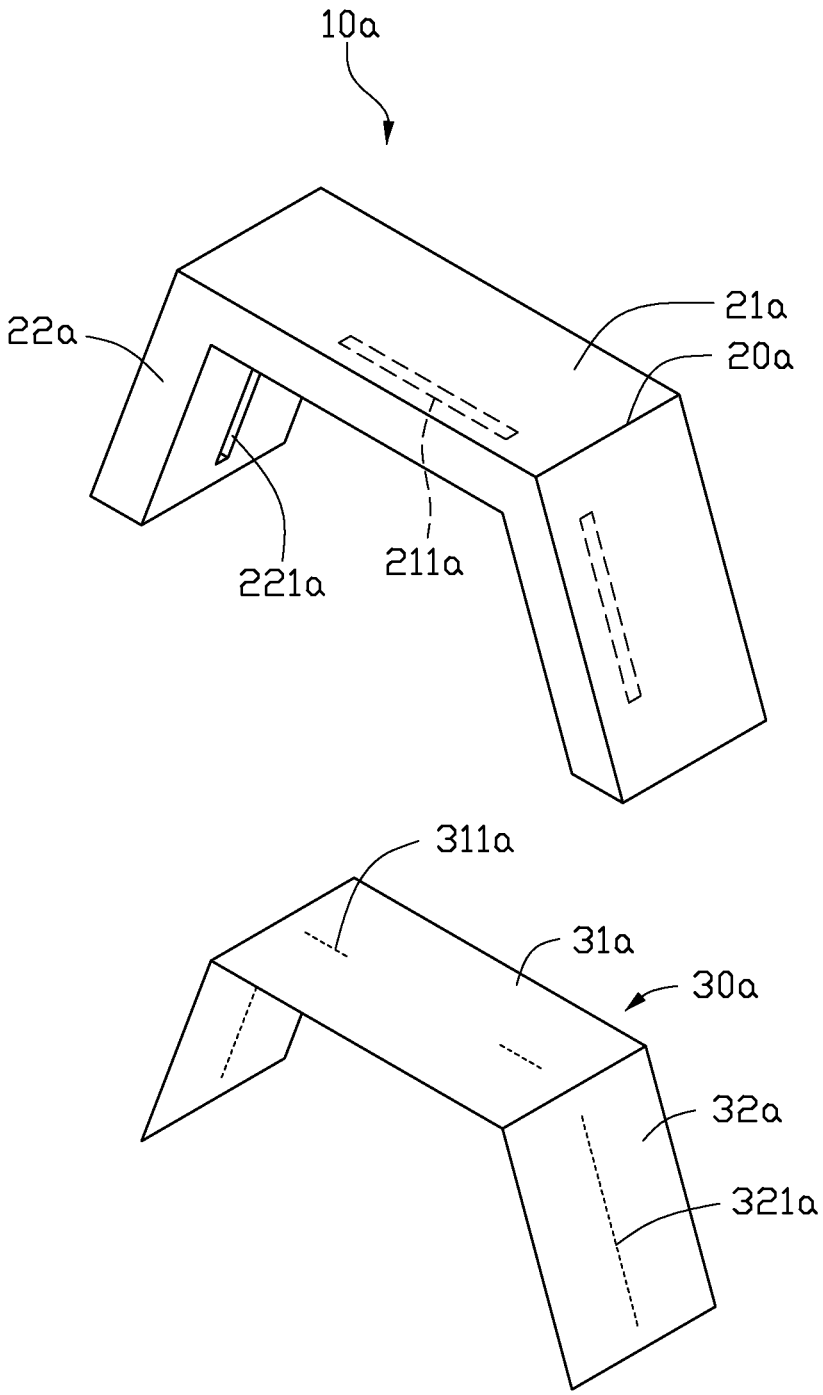
FIG. 4 is an exploded perspective view of another embodiment of a three-dimensional printer.
Figure 5:
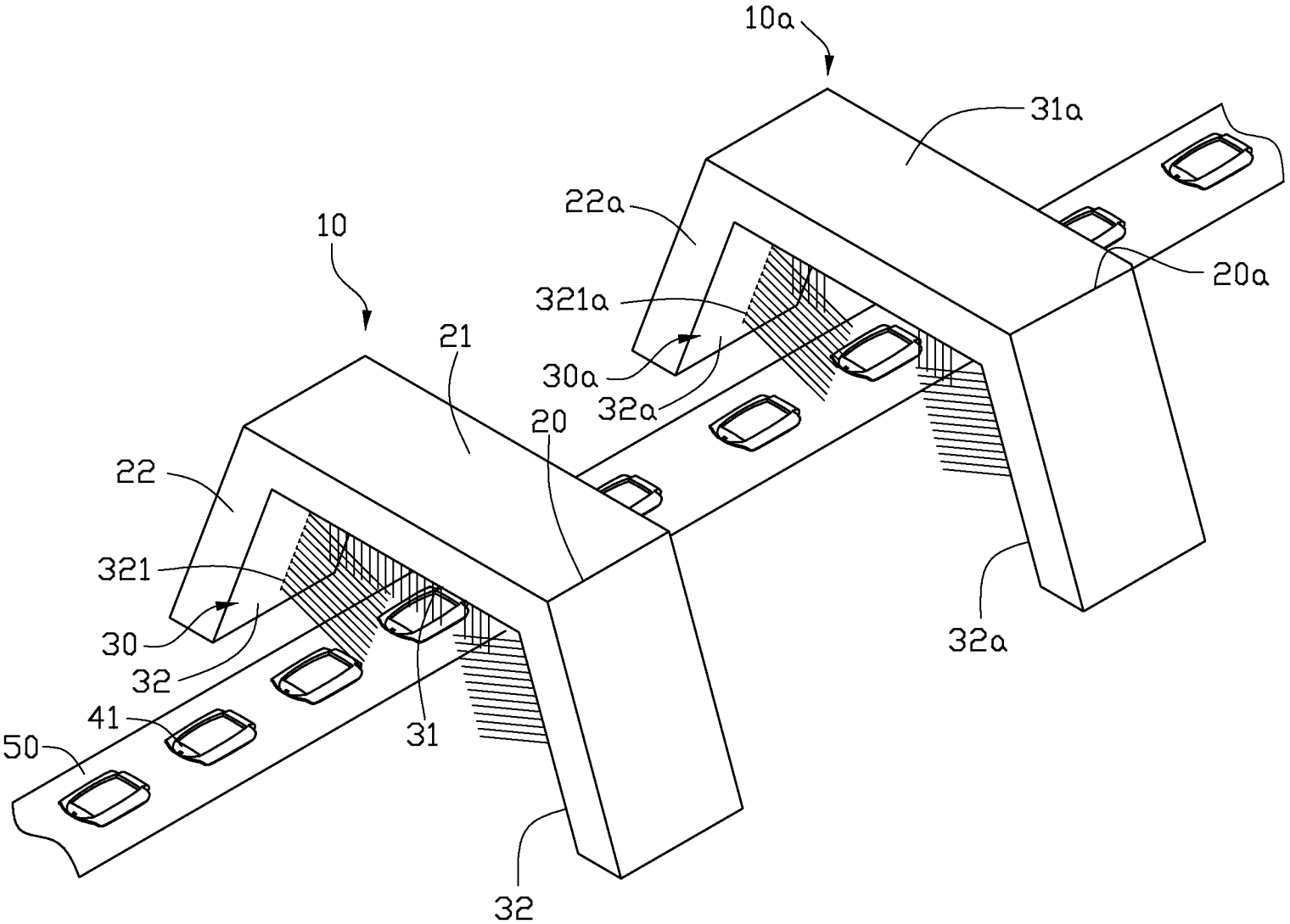
FIG. 5 is a schematic view of the three-dimensional printer of FIG. 4.

Referring to FIGS. 4 and 5, another embodiment of a three-dimensional printer 10*a* is can print a hollow workpiece 41. Two ends of a top area 31*a* of a nozzle 30*a* define a plurality of holes 311*a* with no hole in the center of the top area 31*a*.

Referring to FIG. 5, printers 10, 10*a* are positioned in tandem. When a hollow workpiece 41 enters the first printer 10 by the conveyer belt 50, the first printer 10 prints on a top surface and two side surfaces of the workpiece 41. When the hollow workpiece 41 enters the second printer 10*a* by the conveyer belt 50, the second printer 10*a* prints on the two side surfaces of the workpiece 41. The numbers and the location of the holes of the nozzle can be adjusted based on printing requirements. Thus, ink can be conserved.

It is to be understood that the present disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A three-dimensional printer comprising:

an inkjet head comprising a top wall and two sidewalls connecting with the top wall, the top wall comprising a top nozzle, each sidewall comprising a side nozzle; and a nozzle plate positioned on and contacting directly with an inner surface of the inkjet head, the nozzle plate comprising a top area and two opposite side areas connecting with the top area, the top area of the nozzle plate comprising a plurality of holes corresponding to the top nozzle of the inkjet head, each side area of the nozzle plate comprising a plurality of holes corresponding to the side nozzle of the inkjet head.

2. The three-dimensional printer as claimed in claim 1, wherein the two sidewalls of the inkjet head are integrally formed with the top wall of the inkjet head.

3. The three-dimensional printer as claimed in claim 1, wherein the two sidewalls of the inkjet head are attached to the top wall of the inkjet head.

4. The three-dimensional printer as claimed in claim 1, wherein the inkjet head forms an inverted U-shape.

5. The three-dimensional printer as claimed in claim 1, wherein the nozzle plate forms an inverted U-shape.

6. The three-dimensional printer as claimed in claim 1, wherein a number and location of the holes of the nozzle plate are adjustable according to printing requirements.

7. The three-dimensional printer as claimed in claim 1, wherein the two side areas of the nozzle plate are integrally formed with the top area or attached to the top area of the nozzle plate.

8. The three-dimensional printer as claimed in claim 1, wherein the two side areas of the nozzle plate are attached to the top area of the nozzle plate.

* * * * *